US009909353B2

(12) United States Patent
Hendricks

(10) Patent No.: US 9,909,353 B2
(45) Date of Patent: Mar. 6, 2018

(54) ADJUSTABLE SILL PAN SYSTEM

(71) Applicant: Robert Hendricks, Youngstown, OH (US)

(72) Inventor: Robert Hendricks, Youngstown, OH (US)

( * ) Notice: Subject to any disclaimer, the term of this patent is extended or adjusted under 35 U.S.C. 154(b) by 0 days.

(21) Appl. No.: 15/267,506

(22) Filed: Sep. 16, 2016

(65) Prior Publication Data

US 2017/0081902 A1 Mar. 23, 2017

Related U.S. Application Data

(60) Provisional application No. 62/220,428, filed on Sep. 18, 2015.

(51) Int. Cl.
*E06B 1/70* (2006.01)

(52) U.S. Cl.
CPC ..... *E06B 1/702* (2013.01); *E06B 1/70* (2013.01); *E06B 1/705* (2013.01)

(58) Field of Classification Search
CPC ..... E06B 1/702; E06B 1/705
See application file for complete search history.

(56) References Cited

U.S. PATENT DOCUMENTS 2,697,932 A * 12/1954 Goodwin ..... E06B 1/702 49/504
2,734,602 A * 2/1956 Dawson ..... E06B 1/702 52/204.5
3,139,703 A * 7/1964 Hilt ..... E06B 1/342 52/211
4,079,550 A 3/1978 Bursk et al.
4,492,062 A * 1/1985 Levenez ..... E06B 1/705 52/209
5,136,814 A 8/1992 Headrick
5,179,804 A 1/1993 Young
5,426,894 A 6/1995 Headrick
5,542,217 A 8/1996 Larivee, Jr.
5,588,266 A 12/1996 Headrick
5,611,173 A 3/1997 Headrick et al.
6,098,343 A 8/2000 Brown et al.
6,155,011 A * 12/2000 Robertson ..... E06B 1/342 52/210
6,371,188 B1 * 4/2002 Baczuk ..... E06B 1/70 160/92
6,453,631 B1 9/2002 Headrick
6,345,477 B1 12/2002 Kepler et al.
D523,565 S 6/2006 Antonic
7,222,462 B2 5/2007 Ellingson
7,676,996 B2 3/2010 Teodorovich
7,775,004 B2 8/2010 Allen
7,930,860 B2 * 4/2011 Sawada ..... E06B 1/702 49/408
D638,142 S 5/2011 Van Camp et al.
8,117,789 B2 2/2012 Teodorovich
8,375,659 B2 2/2013 Bogenhagen et al.
8,413,383 B2 4/2013 Van Camp et al.
8,443,554 B1 5/2013 Teodorovich
(Continued)

*Primary Examiner* — Gisele D Ford
(74) *Attorney, Agent, or Firm* — Robert G. Lev

(57) ABSTRACT

An adjustable sill pan system that can be adjusted in the field to fit any type of entryway, while maintaining a moisture-tight seal between parts of the sill pan system, by virtue of a complementary gasket having slots that receive the entirety of an open edge of another part of the sill pan system.

7 Claims, 7 Drawing Sheets

(56) References Cited

U.S. PATENT DOCUMENTS

| | | | | |
|---|---|---|---|---|
| 8,490,332 | B2 | 7/2013 | Van Camp et al. | |
| 8,567,128 | B2 | 10/2013 | Van Camp et al. | |
| 8,695,293 | B2 | 4/2014 | Teodorovich | |
| 9,051,777 | B2 | 6/2015 | Van Camp et al. | |
| 2003/0056450 | A1* | 3/2003 | Bealko | E04C 3/28 52/204.55 |
| 2005/0144856 | A1* | 7/2005 | Conlin | E04D 13/1475 52/58 |
| 2005/0144865 | A1* | 7/2005 | Ellingson | E06B 1/70 52/272 |
| 2005/0217189 | A1* | 10/2005 | Moffitt | E06B 7/14 52/209 |
| 2006/0261636 | A1* | 11/2006 | Bonshor | E06B 1/702 296/155 |
| 2009/0007497 | A1* | 1/2009 | Sawada | E06B 1/705 49/476.1 |
| 2009/0272045 | A1* | 11/2009 | Teodorovich | E06B 1/702 52/58 |
| 2010/0058683 | A1* | 3/2010 | Bushberger | E06B 1/705 52/209 |
| 2012/0144761 | A1* | 6/2012 | Teodorovich | E06B 1/702 52/62 |
| 2014/0260011 | A1* | 9/2014 | Pettibone | E06B 7/14 52/209 |

* cited by examiner

ADJUSTABLE SILL PAN SYSTEM

FIELD OF THE INVENTION

The present invention relates generally to the field of sill pans for doors and windows. In particular, the present invention is directed to an adjustable system for accommodating a wide range of different sill pan sizes and configurations.

BACKGROUND

Sill pans are well-known for constituting flashing for a wide variety of apertures or openings in various structures, especially those for doors and windows in buildings. As flashing, sill pans provide the final barrier between exterior water and the vulnerable interiors of a structure. As such, sill pans are vital for maintaining the integrity of a structure against undesirable moisture migration, and other external factors that can degrade an unprotected building interior. Accordingly, the optimum arrangement to protect an interior from moisture migration and the like is to provide sill pans manufactured specifically for a particular size and configuration of opening.

However, there are so many variations in the aperture sizes for windows and doors that manufacturing specific sill pans for each becomes prohibitively expensive. This is due to the fact that most sill pans are formed by various plastic manufacturing methods, such as injection molding or extrusion. The processes requires specific tools made for each size and configuration of the final product. Since each tooling is extremely expensive, the manufacture of whole sill plates for every type and size of window and door opening is prohibitively expensive.

The industry response has been adjustable sill pans. This has been accomplished most often by the use of arrangements in which one part of the sill pan slides under an adjacent part. This approach has had a number of drawbacks. Firstly, to accommodate a wide range of sizes, extremely large sill pans with substantial overlaps have had to be used. This is wasteful of material, even if it is capable of accommodating a wide range of apertures.

Unfortunately, the overlapping of the two parts of the sill pan creates gaps through which moisture might migrate and enter vulnerable parts of the structure. Further, substantial overlaps lead to awkward installation. Also, to properly interlock the overlapping sill pan parts, complex interlocking structures have to be manufactured as part of the multiple overlapping sill pans. This adds a considerable amount of expense to the manufacture to what should be a relatively simple structure that must be used in many openings (both door and window) of a structure. Likewise, complex interlocking structures lead to difficulty during installation when workmen might not be familiar with a particular sill pan interlocking arrangement.

Accordingly, there is a need in the building industry for an adjustable sill pan system that is simple to install, inexpensive, and efficient against the entry of water or other environmental effects. Further, such a system would have to be easily adjustable to fit a wide range of different entryway and window apertures.

SUMMARY OF THE INVENTION

According, it is a primary object of the present invention to provide a simple, effective adjustable threshold.

It is another object of the present invention to provide a threshold pan system that fits a wide variety of different aperture sizes.

It is still a further object of the present invention to provide a sill pan system that is easily installed.

It is an additional object of the present invention to provide a sill pan system that is simply configured to facilitate ease of adjustment.

It is still another object of the present invention to provide a sill pan system that is very inexpensive to manufacture.

These and other goals and objects of the present invention are achieved by a unitarily molded sill pan system having at least one separate end cap. This end cap includes a slot configuration to receive the edges at the end of a sill pan, using a soft interface to facilitate a moisture-tight seal.

DETAILED DESCRIPTION OF THE PREFERRED EMBODIMENTS

Figure 1:
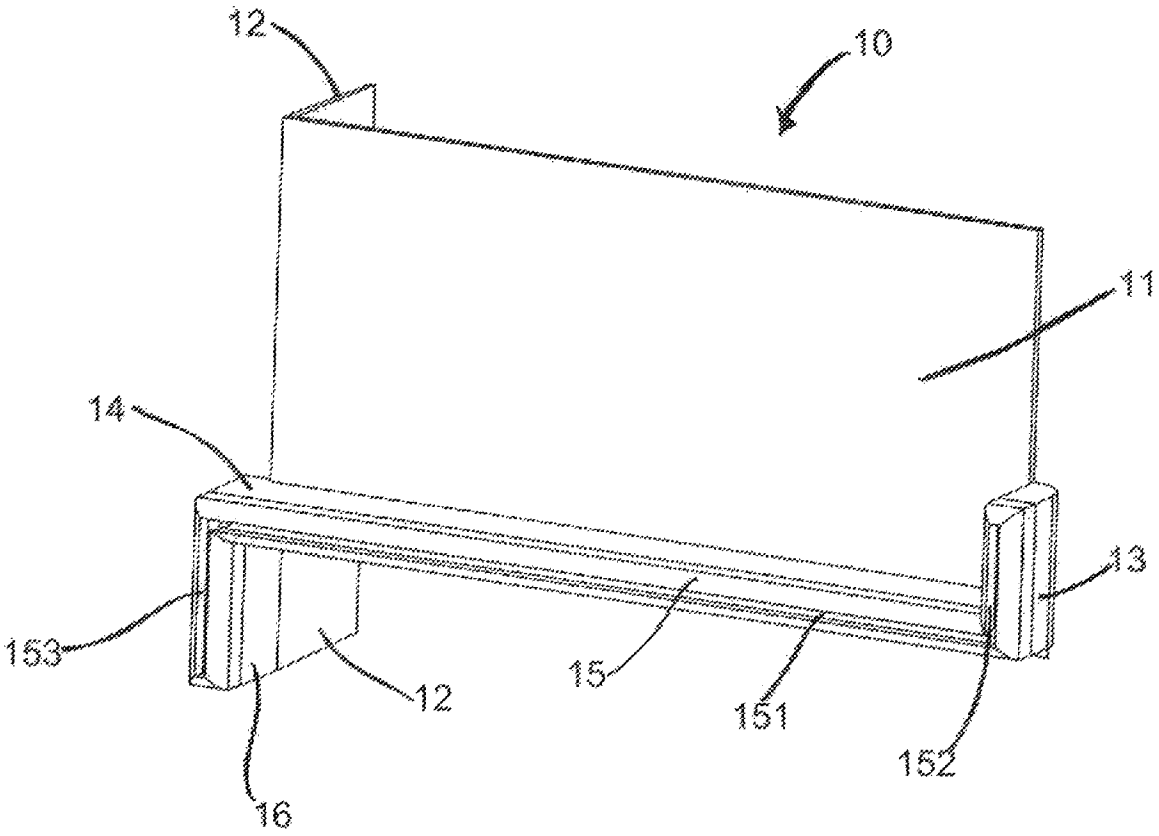
FIG. 1 is a perspective side view of the inventive end cap.
Figure 2:
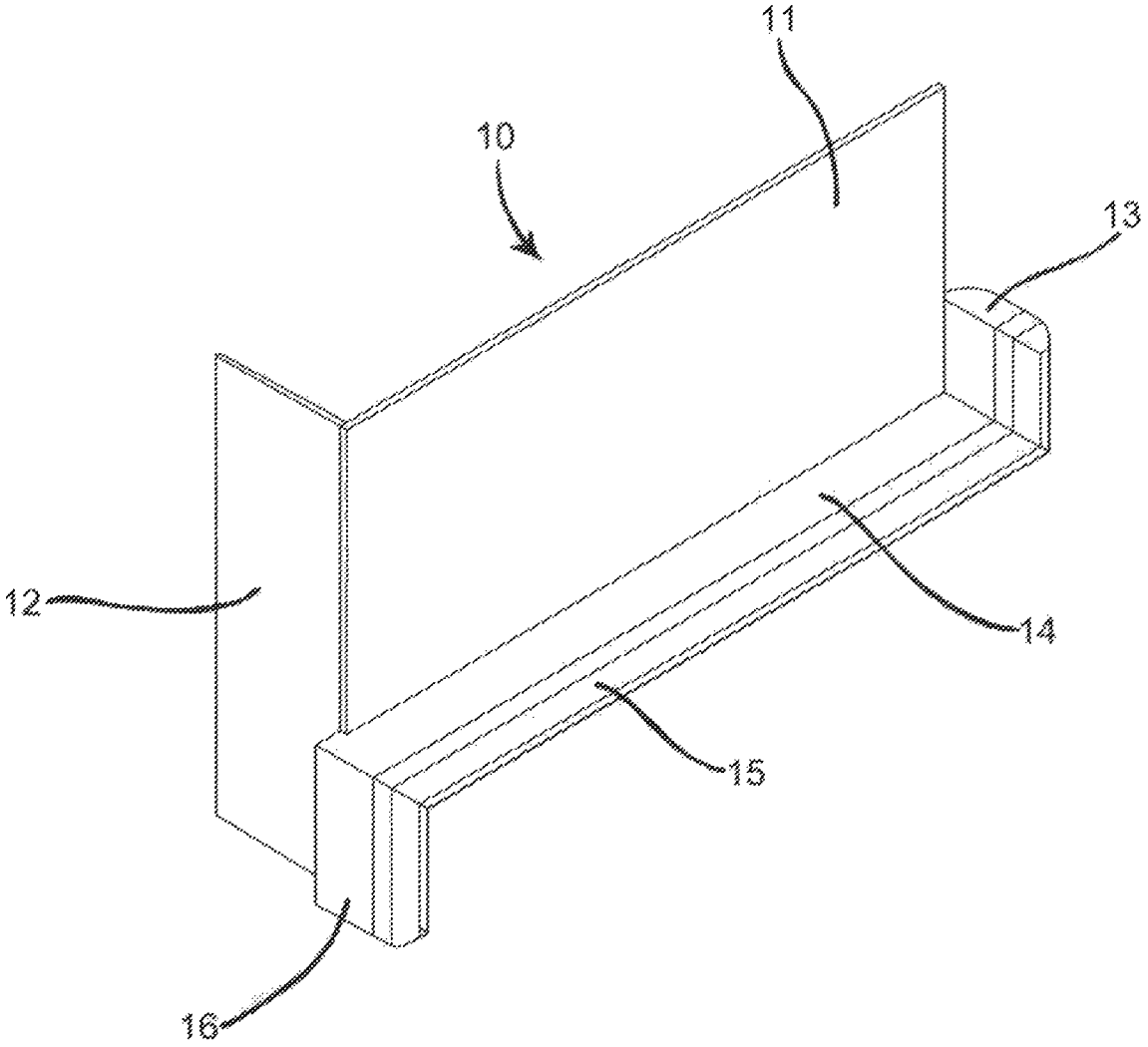
FIG. 2 is a perspective front view of the inventive end cap.
Figure 3:
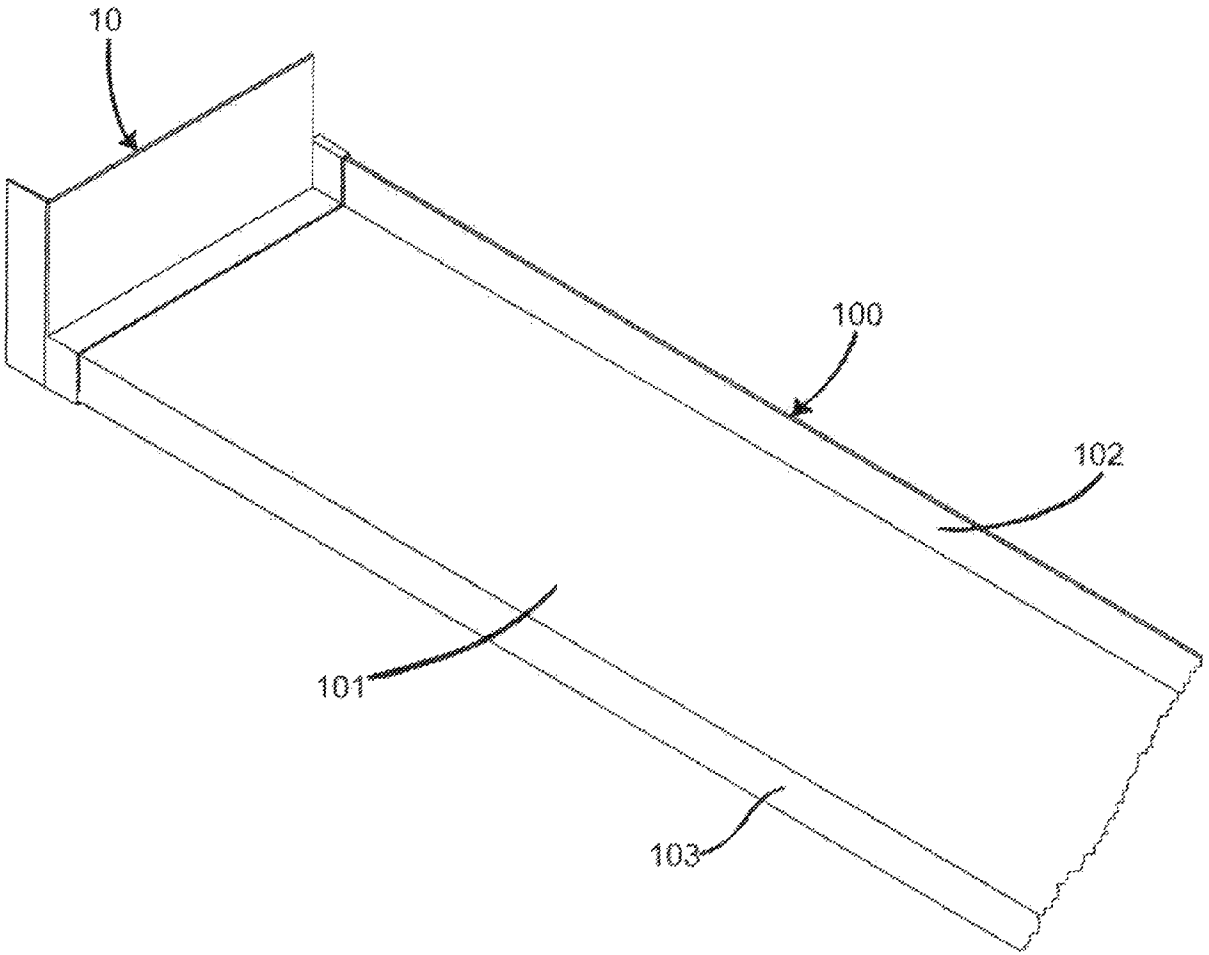
FIG. 3 depicts a standard sill pan attached to the inventive end cap of FIGS. 1 and 2.
Figure 4:
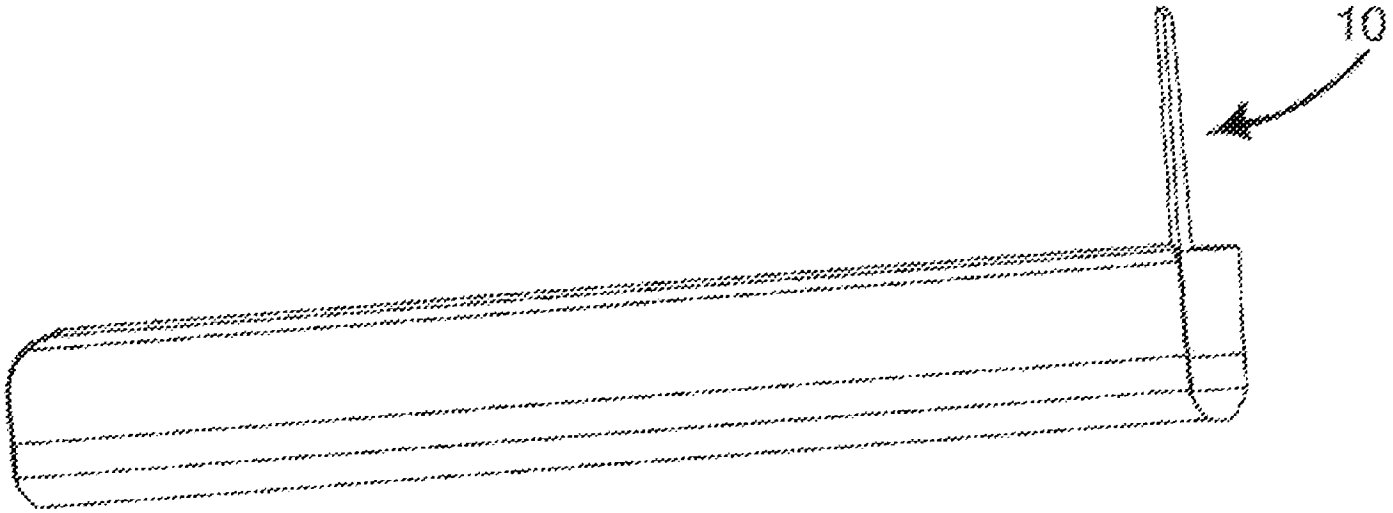
FIG. 4 is a side perspective view depicting the second material used as an interface.
Figure 5:
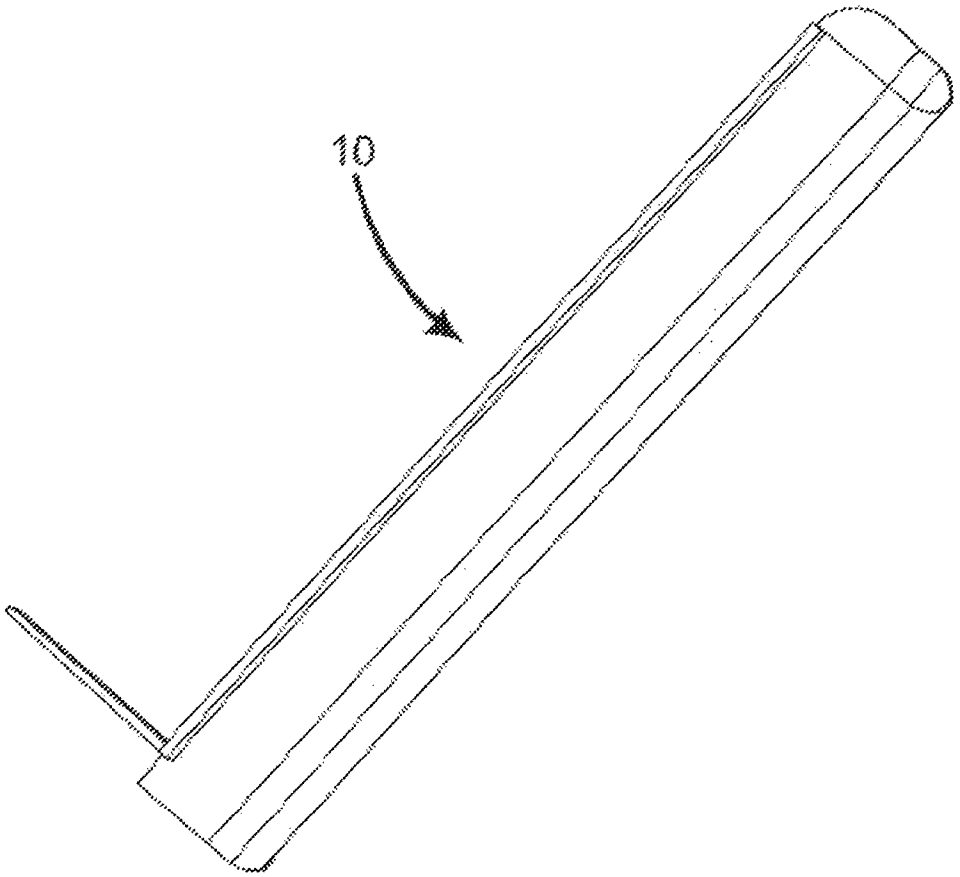
FIG. 5 is another perspective view depicting the second material used as an interface.
Figure 6:
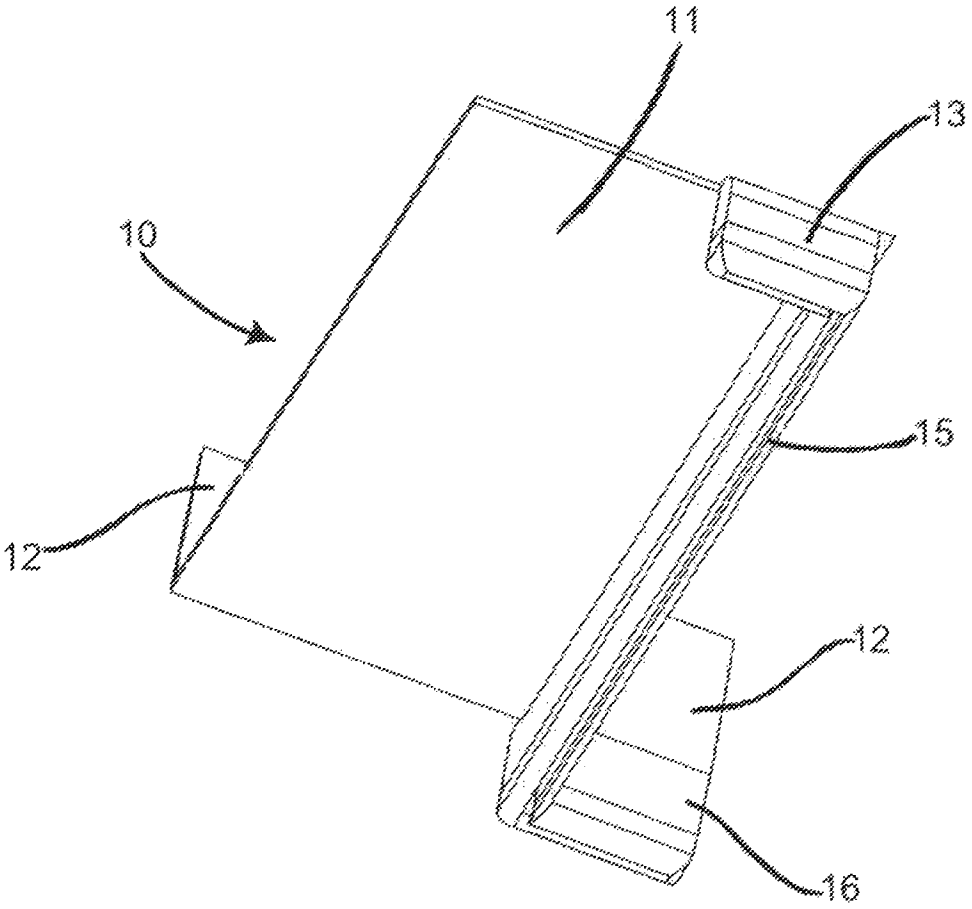
FIG. 6 is a perspective view of FIG. 1, highlighting the second material used as an interface.
Figure 7:
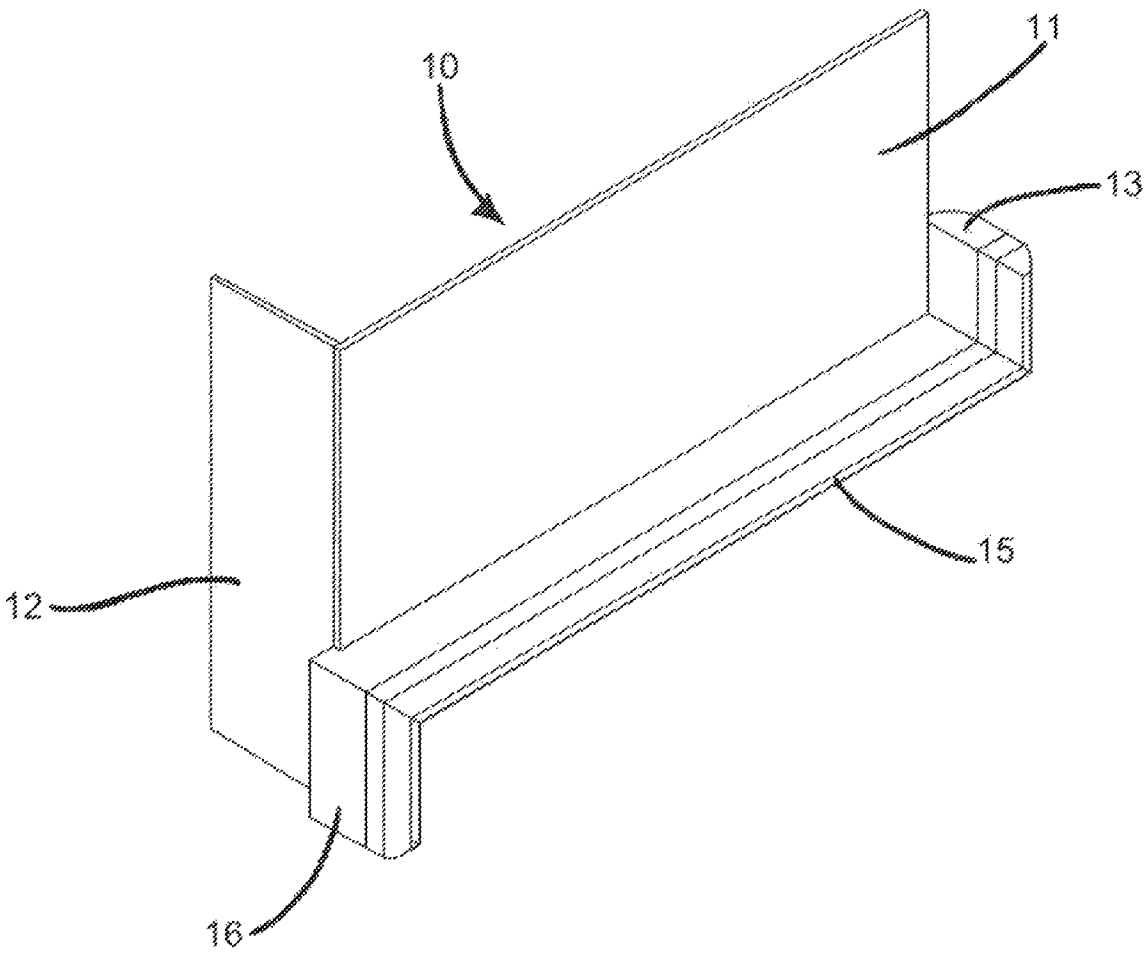
FIG. 7 is a perspective view of FIG. 2, emphasizing the second material used as an interface.

FIG. 3 depicts a conventional sill pan configuration 100. Also depicted in FIG. 3 is the inventive end cap 10. The conventional sill pan 100 includes a rear vertical wall 102, a horizontal plate 101, and a front vertical wall 103. Not shown is unitarily molded end cap 104, which is conventionally the same size and configuration as the removable inventive end cap 10.

The conventional sill pan 100 is unitarily molded of a single appropriate plastic material. The manufacturing process is preferably accomplished by plastic extrusion or injection molding. Conventionally, such sill pans 100 include two unitarily molded end caps 104 (not shown in the drawings), limiting the use of the sill pan 100 to an entryway aperture of a specific size. If the sill pan 100 does not fit a particular aperture, it is generally considered to be useless.

The sill pan system of the present invention is manufactured as one piece 100, with either one or both end caps 104 (not shown) missing. Removable end caps 10 are substituted therefor, to provide adjustability and a water-tight seal. By having one open end free of end cap 104, sill pan 100 can be cut to any appropriate size and a removable end cap 10 placed at the open edge or edges of sill pan 100 to create an effective seal at one or both ends of the sill pan 100.

The hard plastic of sill pan 100 is readily cut to size in the field once the exact measurements of the entryway aperture is determined. As a result, a single manufactured piece is applicable for a wide variety of different entryway apertures, including those of extremely irregular sizes.

The water-tight seal between the edges of sill pan 100 and end cap 10 are achieved by interface 15. This interface (15) is preferably made of a softer material than the rest of the end cap 10 so that the material of interface 15 can serve as a gasket, preventing the migration of moisture. Interface 15 has a horizontal slot 151, a rear vertical slot 152, and a front vertical slot 153. These slots are sized to accommodate the open edges of sill pan 100, which fit into the corresponding slots, and are sealed thereto in a water-tight arrangement by virtue of the adhesion of the soft, gasket material constituting interface 15.

The softer gasket material constituting interface 15 can be manufactured as part of end cap 10 by means of a dual molding process. This ensures that the gasket material of interface 15 is fully integrated with the rest of end cap 10. FIGS. 4, 5, 6, and 7 depict the placement of the softer interface 15 material with that of the rest of end cap 10. As is clear from these drawings, the dark shaded areas depicting the material of interface 15 exactly follows the contour of both the end cap 10 where it would interface with the open edges of sill pan 100. The full integration of the softer gasket material constituting interface 15 with the harder material of removable end cap 10 ensures that there is no migration of liquid where the edge of sill pan 100 connects to removable end cap 10.

It should be noted that the structure of removable end cap 10 mirrors that of sill pan 100. In particular, there is a side face 11, a front lateral extension 12, a rear vertical wall 13, a horizontal plate 14, and a front vertical wall 16. This structure effectively mirrors that of an end cap 104 that is usually molded as part of one end of sill pan 100.

Because of the simplicity of the inventive sill pan system, only two pieces (removable end cap 10 and sill pan 100) are needed for most installations. A second removable end cap 10 is an option if the sill pan 100 is not manufactured with at least one end cap 104. Because interface 15 is preferably not constituted by a removable gasket, installation is simplified due to the reduction in necessary parts along with the chance of losing or damaging some of those parts.

It should be noted that the rear vertical slot 152 of interface 15 is closed at the top to prevent moisture migration. Likewise front vertical slot 153 is closed in order to stop moisture from splashing up into the interface 15. The coverage of the various parts of removable end cap 10 by the interface 15 eliminates all areas in which moisture could migrate due to openings between sill pan 100 and removable end cap 10.

It should be apparent that among the many benefits of the present inventive system, the use of only one size sill pan 100 (or a very limited number of sill pan sizes) will rendered the manufacturing process much less expensive, and thus result in a less expensive product. Because sill pan 100 is expected to be cut in the field, appropriate plastic can be used to manufacture sill pan 100. This is one situation where field measurements and cuts will be superior to those done in a manufacturing facility. Accordingly, the present invention can be used in a wide variety of entryway structures.

It should also be noted that while removable end cap 10 is manufactured as a single piece using dual injection molding, other forms of manufacture can be used instead. For example, the interface 15 can be manufactured separately from the rest of removable end cap 10, and attached thereto at the manufacturing facility. The key is the full coverage of the interface parts of removable end cap 10, so that the entirely of the edge of end cap 10 is contained by interface 15, and the entirety of the edges of sill pan 100 are received within the interface 15. Any manufacturing technique that facilitates this final configuration is found to be within the scope of the present invention.

As a result of the simple, but effective, construction of the subject adjustable sill pan system, a wide variety of benefits can be obtained. While a number of examples for achieving these benefits have been provided in the present application, the present invention is not limited thereto. Rather, the present invention should be interpreted to encompass any and all variations, modifications, adaptations, derivations, and embodiments that would occur to one skilled in this art, and having knowledge of the present invention. Accordingly, the present invention should be limited only by the following claims.

The invention claimed is:

1. An adjustable sill pan system, comprising:

a) an elongated sill pan configured to interface with an entryway of a building, said elongated sill pan having a horizontal plate, a front vertical wall extending downwards from said horizontal plate, and a rear vertical wall extending upwards from said horizontal plate, wherein said horizontal plate, said front vertical wall and said rear vertical wall comprise at least three contiguous lateral edges; and, b) at least one detachable end cap formed of a first material and a second gasket material, the first material being harder than the second gasket material, wherein said second gasket material is configured as three contiguous slots forming a contiguous perimeter positioned and sized to enclose the entirety of said three contiguous lateral edges within said contiguous perimeter, sealing each said lateral edges within a respective one of said three contiguous slots.

2. The adjustable sill pan system of claim 1, wherein said three contiguous lateral edges and said three contiguous slots of said second gasket material form a water-tight connection when said three contiguous lateral edges are received in said three contiguous slots.

3. The adjustable sill pan system of claim 2, wherein said elongated sill pan is unitarily formed as a single piece.

4. The adjustable sill pan system of claim 3, wherein a second end cap is formed as part of said elongated sill pan as a single unit.

5. The adjustable sill pan system of claim 2, further comprising a second detachable end cap formed of a material and a second gasket material, the first material being harder than the second gasket material.

6. The adjustable sill pan system of claim 5, wherein said detachable end caps are integrally formed using a dual molding process.

7. The adjustable sill pan system of claim 2, wherein said contiguous three slots are closed, thereby preventing migration of moisture around said water-tight connection.

* * * * *